US005608993A

United States Patent [19]

Argiropoulos

[11] Patent Number: 5,608,993

[45] Date of Patent: Mar. 11, 1997

[54] MINI-WALL PARAPET FOR ROOF EDGING OR COPING

[76] Inventor: John G. Argiropoulos, 4741 N. Rock Spring Rd., Arlington, Va. 22207

[21] Appl. No.: 641,548

[22] Filed: May 1, 1996

[51] Int. Cl.[6] ..... E04D 1/36

[52] U.S. Cl. ..... 52/96; 52/61

[58] Field of Search ..... 52/58, 60, 61, 52/62, 300, 96, 470, 528, 94, 63, 222, 732.1

[56] References Cited

U.S. PATENT DOCUMENTS

| | | | |
|---|---|---|---|
| 3,405,485 | 10/1968 | Edwards | 52/60 X |
| 3,668,811 | 6/1972 | Pollard | 52/94 |
| 3,719,010 | 3/1973 | Hickman | 52/60 |
| 3,862,531 | 1/1975 | Attaway et al. | 52/58 X |
| 3,992,827 | 11/1976 | Johnson | 52/60 |
| 4,083,158 | 4/1978 | Wolma | 52/60 X |
| 4,155,203 | 5/1979 | Wolma | 52/94 X |
| 4,598,507 | 7/1986 | Hickman | 52/94 |
| 4,780,999 | 11/1988 | Webb et al. | 52/96 |
| 4,858,406 | 12/1989 | Lane et al. | 52/300 |
| 4,964,248 | 10/1990 | Braine et al. | 52/60 |
| 4,969,250 | 11/1990 | Hickman et al. | 52/58 X |
| 5,189,853 | 3/1993 | Braine et al. | 52/96 |
| 5,239,791 | 8/1993 | Mills, Jr. et al. | 52/58 |

*Primary Examiner*—Carl D. Friedman
*Assistant Examiner*—Yvonne Horton-Richardson
*Attorney, Agent, or Firm*—Thomas E. Lynch

[57] ABSTRACT

A sheet metal mini-wall parapet structure is provided. The structure is basically a U-shaped member formed of sheet metal. At one lower corner of the U-shaped member is formed the cleat used to attach the conventional coping member. The cleat is formed by extending one leg of the U-shaped member downwardly and folding it over in a continuous fashion with an extension from the bottom of the U-shaped member. The upright legs of the U-shaped member are staggered in height so that when a top member is attached, the top member is sloped in one direction so that any water accumulating on the top of the mini-wall parapet is drained toward the roof. The top member is usually of ¾" pressure treated plywood which is screwed into bent over flanges along the tops of each leg of the U-shaped member. Before the top member is screwed into place, the void within the sheet metal legs can be filled with insulation to minimize heat loss through the mini-wall parapet. By screwing the top member in place, the whole structure is rendered rigid. When necessary, the opposite upright leg of the U-shaped member can include a triangular protrusion which serves the same function of the wood cant structure required in certain installations. Finally, when the roof insulation, the roof membrane and the coping seal member are installed, the outward appearance is aesthetically identical to prior art mini-wall parapet structures.

10 Claims, 1 Drawing Sheet

MINI-WALL PARAPET FOR ROOF EDGING OR COPING

BACKGROUND OF THE INVENTION

1. Field of the Invention

The present invention pertains generally to an article of manufacture which facilitates the application and sealing of sheet-like membrane roofing materials to the outside edges of buildings, more particularly, to a sheet metal mini-wall parapet which replaces prior art wood and/or masonry mini-wall parapets which are labor intensive and are relatively expensive to make and install. More particularly, the mini-wall parapet of this invention allows it to be substantially fully prefabricated of sheet metal such as galvanized steel, aluminum or stainless steel which is bent to form the finished product without the use of wood or masonry forming the bulk of the structure.

2. Discussion of the Background of the Invention

Roof edge sealing constructions referred to in the literature by several names such as mini-wall parapets, coping structures, roof edge assemblies, gravel stop assemblies, water dams, and the like, have been provided for the purposes of sealing the outer edges of construction components, anchoring sheet-like roofing or sealing membranes, retaining gravel ballasts, controlling water drainage, or for supporting facia members at the interfaces between various constructions and structures. For purposes of this disclosure, I will refer to these devices generally as mini-wall parapets. In the description of the drawings which follows, all elements in common with Prior Art FIG. 1 will include the same numbering system. Also, the dimensions of the various elements are not necessarily true to scale, but may be exaggerated in thickness or thinness to facilitate their disclosure.

Typically, as disclosed by prior art FIGS. 1(A–B), such an edge sealing mini-wall parapet 1 is fabricated on site at the edge of a roof by layering a plurality of wood planks (such as 2×6's or 2×8's) as shown. Such a wood plank mini-wall parapet 1 is typically formed from so-called pressure treated wood so that it is assured of moisture and insect resistance, but untreated wood can be utilized as well. The lowermost layer 3 of the wood plank mini-wall parapet is screwed to the roof deck 2 when the roof deck 2 is of wood or metal construction. If the deck 2 is of concrete or masonry construction, the lowermost layer is secured by anchor bolts or masonry fasteners 4. In both FIGS. 1(A–B), the edge of the roof deck 2 is shown over a typical outside wall which is composed of brick 19 and block 20. Each of the subsequent wood plank layers are nailed to the next lower layer by nails 5. The number of layered planks required is determined by the thickness of the insulation layer 6 on top of the roof deck 2. The height of the mini-wall parapet must be at least 3½" higher than the height of the insulation layer as in FIG. 1(A). The roof membrane 7 is installed over the insulation layer 6, and usually laps over the top of the mini-wall parapet 1 as shown.

When the roof membrane 7 is formed from hot rubberized asphalt, it is usually applied directly to the roof deck 6 as shown in prior art FIG. 1B. Thus, when this technique is utilized, the insulation layer 6 is placed over the membrane 7 followed by a felt layer 8 and a layer of gravel 9. When this roofing system is employed, a ninety degree bend of the sheet membrane 7 is not permitted. Therefore, a 3"×3" cant member 10 is nailed to the inside corner of the mini-wall parapet. This cant member 10 is formed from a 3"×3" wood member which is sawed diagonally so that the upper and lower angles are only 45 degrees. Cant members 10 are also available pre-sawed from commercial roofing materials suppliers. When these cant members are employed, the height of the mini-wall parapet must be at least 3½" above the top edge of the cant member 10.

The top surface 11 of the final layer of the mini-wall parapet must be tilted toward the surface of the roof as shown in each of the FIGS. 1(A–B). This tilt is provided to drain any moisture which accumulates along the top of the mini-wall parapet 1 toward the roof without allowing it to drip along the outside wall of the building.

The final tilted layer of the mini-wall parapet 1 can be formed in several ways. Any appropriate way is permissible provided that the upper surface 11 is sloped inwardly toward the roof surface at a slope of approximately ¾" for an eight inch width. Thus, the upper surface 11 of the mini-wall parapet can be formed, for example, by a 2"×8" plank milled to this slope as shown in prior art FIG. 1A, or the upper surface 11 can be tilted by shim 12 at its outside edge as shown in prior art FIG. 1B, so that the top surface 11 of the upper plank has this slope when nailed in place. The milled upper surface 11 is the preferred approach because the fit between the layers is maintained, but milled wood planks with such a slope are not commercially available so they must be milled by the installer. Clearly, this is labor intensive procedure for the installer. The shim technique is not as labor intensive, but it creates a void 13 between the layers and it causes the outside edges 14 of the upper layer 11 to be no longer perfectly square. These problems subject the final outer surface sheet metal coping member 15 of the mini-wall parapet to possible damage or denting in use because it does not fit snugly around the upper surface of the mini-wall parapet 1.

After the wood plank portion of the prior art mini-wall parapet of FIGS. 1(A–B) is installed, an elongated cleat 16 of sheet metal is nailed or screwed at 17 laterally along the length of the outside wall of the mini-wall parapet 1. If desired for a tighter fit of the coping 15, a similar cleat may also be installed along the inside wall of the mini-wall parapet as disclosed in several of the prior art patents identified in the INFORMATION DISCLOSURE STATEMENT, which is hereby incorporated by reference.

The bottom edge of the cleat 16 is bent outward slightly as shown in prior art FIGS. 1(A–B) so that the outer finishing cap or coping member 15 of sheet metal can be installed over the whole mini-wall parapet. The cleat extends down past the interface 18 between the deck and the lower layer of the mini-wall parapet so that the coping member 15, when installed, covers and protects the interface 18 between the mini-wall parapet and the roof deck. The coping member 15 is prefabricated by bending sheet metal in the shape shown. The coping member 15 includes an upperly bent flange (unlabelled as shown) which fits snugly behind the cleat 16 when installed. The coping member 15 is installed by wedging this upwardly bent flange behind the bottom edge of the cleat member, and stretching the top of the coping member over the top of the mini-parapet 1 as indicated by the dotted structure in prior art FIG. 1A. The coping member 15 and the cleat 16 are sufficiently flexible so that they can be elastically deformed when the coping is stretched over the top of the mini-wall parapet (shown dotted in FIG. 1A) without exceeding the elastic limit of any of the bends in the coping or the cleat. Thus, when installed, the coping 15 snaps snugly and permanently over the top of the mini-wall parapet and tightly covers all of the mini-wall parapet material and the sealed edge of the roof membrane 7 underneath the coping. Therefore, the mini-wall parapet and the sealed edge of the roof membrane are fully protected from weather and moisture. The coping structure 15 of prior art FIG. 1B is installed in the same manner.

SUMMARY OF THE INVENTION

The object of this invention is to provide a sheet metal mini-wall parapet for sealing the roof membrane to the edge of a building, whereby a superior insulated seal is obtained while at the same time providing that seal for less cost than conventional mini-wall parapet structures.

It is a further object of this invention to replace conventional wood plank mini-wall parapet structures with a sheet metal structure which is longer lasting than wood plank mini-wall parapet structures, which provides a superior roof membrane seal, which is a much simpler structure, which is a much less expensive structure to manufacture and to install, and which provides a structure that can be insulated so that a superior heat loss factor is obtained.

It is a still further object of this invention to replace conventional masonry mini-wall structures with a sheet metal structure which provides a superior roof membrane seal, a much simpler structure, a much less expensive structure to manufacture and to install, and a which provides a structure that can be insulated so that a superior heat loss factor is obtained.

It is a further object of this invention to provide a mini-wall parapet which is not only inexpensive and simple, but is aesthetically indistinguishable from conventional prior art mini-wall parapet structures.

DESCRIPTION OF THE PREFERRED EMBODIMENT

Figure 1A:
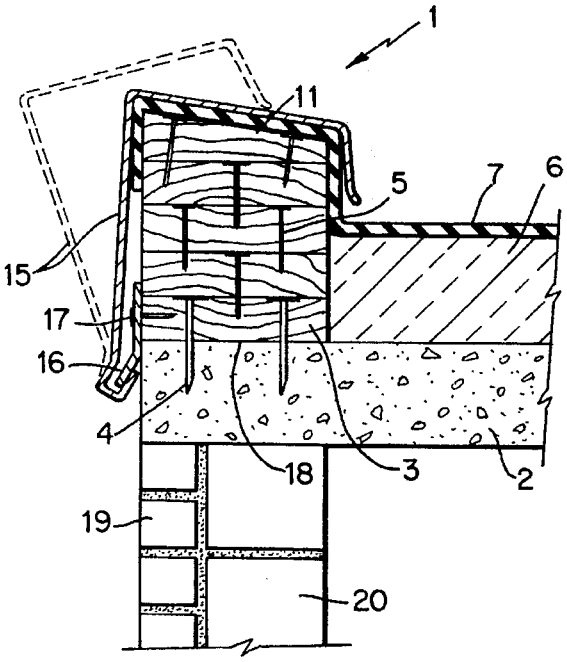
Fig.1A (PRIOR ART)
FIGS. 1(A–B) are conventional prior art wood plank mini-wall parapets.
Figure 2A:
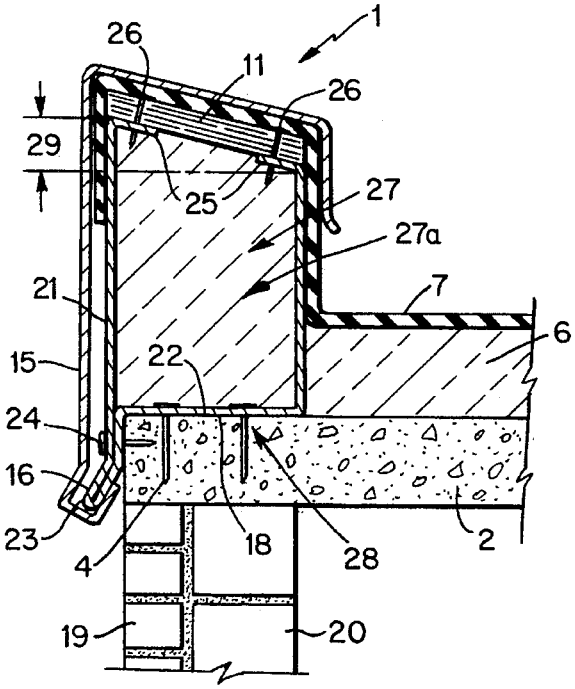
FIGS. 2(A–B) are directed to the structure of my invention including sheet metal mini-wall parapet structures which are fabricated either with or without the cant member as needed.
Figure 2B:
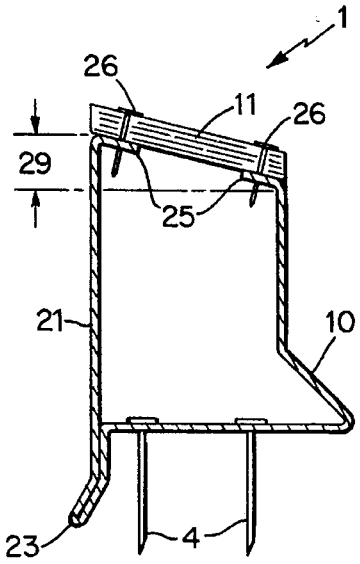

My preferred embodiment is disclosed in FIG. 2A, with FIG. 2B being a variation of FIG. 2A. Again, each element in common with Prior Art FIG. 1A will include the same numbering system. Also, the thickness or thinness of the various elements may be exaggerated to facilitate their disclosure.

FIG. 2A discloses my mini-wall parapet in cross section. The basic structure 21 is formed of one-piece sheet metal shaped in a generally U-shaped configuration. The basic structure 21 is usually prefabricated in the shop prior to installation at the site. This prefabrication greatly simplifies the construction of my mini-wall parapet.

The gage of the sheet metal is chosen such that the walls of my mini-wall parapet 1 have sufficient strength in the vertical direction to easily function as a mini-wall parapet. As in FIG. 1A, the bottom wall member 22 is attached to the roof deck 2 by screws or masonry anchors 4 depending on the composition of the deck 2. The lower left hand corner of the U-shaped element is bent down and folded over at 23 to form the cleat 16. The bottom of the cleat 16 is bent outwardly in the same manner as the prior art cleats to facilitate the application of the coping member also in the same manner as the prior art. The big advantage of this folded over structure is that the cleat is integral with the mini-wall parapet, and thus, it does not require any separate installation as do the cleats in the prior art. Because of my folded over structure, my cleat is much stronger than conventional cleats, and usually does not require further attachment to the side of the mini-wall parapet. If deemed necessary, however, the cleat portion 16 can be further adhered to the roof deck by the optional fasteners 24.

At the top of the U-shaped element 21 are two staggered elements 25 folded over as shown. The two staggered folded over elements 25 are staggered in the vertical direction as indicated by the dimension 29 in FIGS. 2A and 2B and sloped to receive the top member 11. The staggered folded over elements 25 provide the same slope as the milled or shimmed top member in the prior art. The top member 11 is preferably of ¾" pressure treated plywood because in certain installations nailing into the member 11 may be required. The top member 11 can also be prefabricated in the shop if desired, but it is not installed to U-shaped element 21 until it is in the field.

The top member 11 is screwed to the folded over elements 25 by screws 26 which rigidify the whole mini-wall parapet structure. Also, while other materials, such as sheet metal, might be used in place of pressure treated plywood, plywood is the most convenient material because it can be nailed if necessary, and it provides wood corner edges at the top of the mini-wall parapet. Wood corner edges are less abrasive against the membrane 7 both during and after it is installed. Thus, the combination of the wood corner edges and the smooth sides of the sheet metal U-shaped member 21 cause a superior construction which causes little or no chafing or scratching of the membrane 7 during installation and during the subsequent expansion and contraction of the roof elements during its lifetime, as compared with wood or masonry mini-parapets.

The top member 11 is not installed to the prefabricated sheet metal element 21 in the shop, because access through the top of the structure is required for the application of the fasteners 4 to the roof deck 2. Also, the hollow opening 27 can be filled with insulation **27*a*, such as fiber glass, foam or mineral wool, etc. This provides a better insulation for the heat loss 28 which can be significant through the corners of a building when using the prior art wood or masonry mini-wall parapets. After the insulation 27*a* is installed, the plywood top element 11** is installed, as described above.

Once element 11 of the mini-wall parapet of FIG. 2A is installed, the insulation layer 6, the membrane 7, and the coping member 15 are installed in the same manner as the prior art. Moreover, after the insulation 6, the membrane 7 and the coping member 15 are installed using my mini-wall parapet, the outward appearance is identical from an aesthetic standpoint to the outward appearance of the prior art.

Figure 1B:
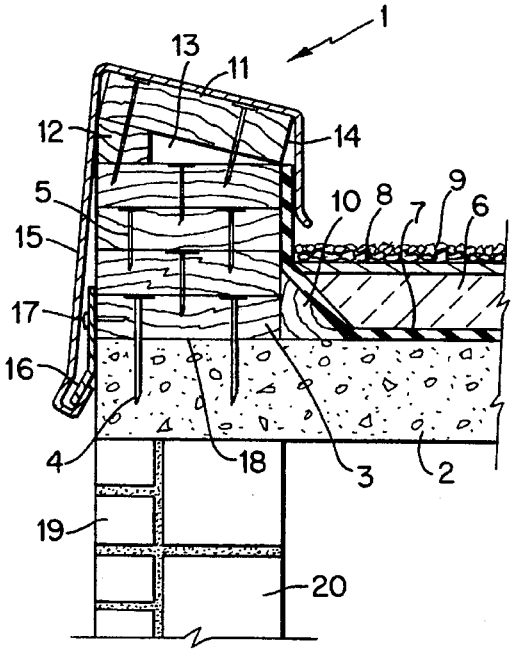
Fig.1B (PRIOR ART)

FIG. 2B is constructed in generally the same manner as is FIG. 2A. For ease of explanation, only the mini-wall parapet structure itself is shown. In this embodiment, the right hand wall of the element 21, is further shaped with a triangular protrusion 10 which is the same size, shape and placement as the cant member 10 of the prior art FIG. 1B. This protrusion 10 thus functions in the identical manner as the cant member 10 in FIG. 1B. Therefore, the structure of FIG. 2B is used when the membrane is hot rubberized asphalt as described above with respect to FIG. 1B. Thus, FIG. 2B also discloses a mini-wall parapet structure which is much simpler to construct than the prior art FIG. 1B construction, or of the other prior art devices referred to above.

Without further analysis, the foregoing so fully reveals the gist of the present invention that others can, by applying current knowledge, readily adapt it for various applications without omitting features that, from the standpoint of the prior art fairly constitute essential characteristics of the generic and specific aspects of my contribution to the art, and therefore, such adaptions should and are intended to be comprehended within the meaning and range of equivalence of the appended claims.

I claim:

1. A mini-wall parapet structure for the edge of a building roof, said roof including an insulation layer and a roof membrane to prevent entry of water into said building comprising:

a. An elongated generally U-shaped in cross section sheet metal member including two vertical side walls, and a bottom wall at a first level joining said two vertical side walls, forming lower corners;

b. One of said lower corners of said generally U-shaped sheet metal member being formed of a continuous extension from one of said vertical side walls of said generally U-shaped sheet metal member, and from an extension of said bottom wall of said generally U-shaped sheet metal member;

c. Said extensions being folded together and extended vertically downward below said first level of said bottom wall of said generally U-shaped sheet metal member to form a cleat for said mini-wall parapet structure;

d. The tops of said two vertical side walls of said generally U-shaped member being bent inwardly to provide a supporting and attaching structure;

e. A top member attached to said tops of said two vertical side walls;

f. Said top member attached to said side walls by convenient attaching means, and providing rigidity to said mini-wall parapet.

2. A sheet metal mini-wall parapet structure for the edge of a building roof subject to entry of water comprising:

a. A generally U-shaped in cross section sheet metal member including two vertical side walls and a bottom wall joining said vertical side walls forming the lower corners of said generally U-shaped sheet metal member;

b. A flange downwardly extending from one of said lower corners of said generally U-shaped member forming a cleat which serves to anchor a subsequently applied coping member;

c. A sheet metal cant member formed in one of said vertical side walls of said generally U-shaped member which extends upwardly from said other lower corner of said generally U-shaped member;

d. A top member which locks said two vertical side walls of said generally U-shaped member together.

3. A mini-wall parapet structure as recited in claim 1, further comprising:

a. A triangular sheet metal cant member formed in said opposite lower corner of said generally U-shaped sheet metal member extending upwardly along said other vertical side wall of said generally U-shaped sheet metal member.

4. A mini-wall parapet structure as recited in claim 1, further comprising:

a. Said tops of said vertical side walls of said generally U-shaped sheet metal member being staggered vertically, whereby when said top member is attached to said side walls, it slopes downwardly toward said roof to drain said water accumulating on said mini-wall parapet structure towards said roof.

5. A sheet metal mini-wall parapet structure as recited in claim 2, further comprising:

a. Said two vertical walls of said generally U-shaped sheet metal member being staggered vertically, whereby when said top member locks said two vertical side walls together, said top member slopes downwardly toward said roof to drain said water accumulating on said sheet metal mini-wall parapet structure towards said roof.

6. A mini-wall parapet structure as recited in claim 1, further comprising:

a. Said top member being formed of pressure treated plywood;

b. Said top member enclosing a hollow void within said mini-wall parapet structure.

7. A mini-wall parapet structure as recited in claim 6, further comprising:

a. Insulation placed within said hollow void enclosed within said mini-wall parapet structure;

b. whereby heat loss through said mini-wall parapet structure is significantly prevented.

8. A sheet metal mini-wall parapet structure as recited in claim 2, further comprising:

a. Said top member being formed of pressure treated plywood;

b. Said top member when locked to said vertical walls of said generally U-shaped sheet metal member enclosing a hollow void within said generally U-shaped sheet metal parapet structure.

9. A sheet metal mini-wall parapet structure as recited in claim 8, further comprising:

a. Insulation placed within said hollow void enclosed within said generally U-shaped sheet metal parapet structure;

b. whereby heat loss through said sheet metal mini-wall parapet structure is minimized.

10. A mini-wall parapet structure as recited in claim 1, wherein said mini-wall parapet structure mates with said roof insulation layer, said roof membrane and a sealing coping member in the same way as prior mini-wall parapets, and wherein the finished mini-wall parapet is aesthetically indistinguishable from said prior mini-wall parapets.

* * * * *